United States Patent [19]

Sumitomo et al.

[11] Patent Number: 4,841,916

[45] Date of Patent: Jun. 27, 1989

[54] EVAPORATING APPARATUS WITH PREHEATER

[75] Inventors: Hiroyuki Sumitomo; Akira Horiguchi, both of Osaka, Japan

[73] Assignee: Hisaka Works, Limited, Osaka, Japan

[21] Appl. No.: 197,354

[22] Filed: May 23, 1988

[30] Foreign Application Priority Data

May 25, 1987 [JP] Japan ..... 62-129283
Sep. 21, 1987 [JP] Japan ..... 62-238445

[51] Int. Cl.[4] ..... F22B 1/02

[52] U.S. Cl. ..... 122/32; 122/412; 122/451 S

[58] Field of Search ..... 60/651, 653; 122/412, 122/451 S, 451.1, 451.2, 34, 32

[56] References Cited

U.S. PATENT DOCUMENTS 4,562,995 1/1986 Enjo et al. ..... 60/651 X
4,651,531 3/1987 Enjo et al. ..... 60/651
4,779,424 10/1988 Sumitomo et al. ..... 60/651

*Primary Examiner*—Edward G. Favors
*Attorney, Agent, or Firm*—Armstrong, Nikaido, Marmelstein, Kubovcik & Murray

[57] ABSTRACT

An evaporating apparatus includes an evaporator (E) for converting a liquid into vapor and a preheater (2) for heating the liquid before it is fed to the evaporator (E). A pump (6) for feeding the liquid to the preheater (2) and another pump (8) for pressurizing the liquid passing from the preheater (2) to the evaporator (E) are provided, where the former maintains the liquid at a saturation pressure with respect to a temperature slightly higher than a saturation temperature ($t_o$) at the preheater outlet, and the latter serves to raise the liquid pressure to a saturation pressure with respect to a desired evaporation temperature ($t_2$). Rate of flow of a heating medium for the preheater (2) is controlled so that its temperature ($t_{w3}$) is slightly higher than a liquid preheater outlet temperature ($t_{ex}$). Thus, in the preheater (2), the liquid temperature ($t_{ex}$) is maintained lower than saturation temperature ($t_o$), ensuring a greater amount of heat transfer by subcool boiling.

2 Claims, 3 Drawing Sheets

EVAPORATING APPARATUS WITH PREHEATER

BACKGROUND OF THE INVENTION

1. Field of the Invention

This invention relates to the preheating of a heat load liquid which is to be fed to an evaporator, before it is heated in the evaporator, and the invention is applicable, not in a restrictive sense, to the preheating of an organic working fluid, such as flon used in a flon turbine generating system. The term flon refers to those known as Freon (a trademark).

2. Related Art

An evaporator is used to heat a liquid for changing it into vapor, by subjecting the liquid to heat exchange with a heating medium to cause it to take latent heat for evaporation away from the heating medium. A preheater is used to obtain higher temperature vapor by using the same heating medium. A flon turbine generating system will now be described by way of example.

A flon turbine generating system is a heat recovery system having the Rankine cycle applied thereto, an example of which is described in Japanese Patent Application Laid-Open Specification No. 60-144594. It comprises an evaporator for evaporating flon, which is a working fluid, by heating it with industrial wastewater used as a heat source, a vapor prime mover, or vapor engine, adapted to be driven for rotation by the high temperature and high pressure flon vapor produced by the evaporator, a condenser for cooling and condensing the flon vapor reduced in pressure as it has done work, and a flon circulating pump for feeding liquefied flon back to the evaporator; these components are connected together in a closed loop, and the output shaft of the vapor prime mover is connected to an electric generator.

The function of the evaporator is to evaporate liquid phase flon and cause the latter to take latent heat away from the heating medium, so as to provide high temperature high pressure flon vapor. And the higher the flon vapor temperature, the greater the output of the system. Thus, to provide a higher output by using the same heat source, it is contemplated to increase the vaporization temperature in the evaporator by preheating flon liquid.

However, since the heat conductivity of flon or the like used as this kind of working fluid is as low as about 1/10 of that of water, the coefficient of overall heat transmission obtained will be low if a conventional evaporator is used and even if a plate type heat exchanger, which is said to be highly effective, is used, only 500 kcal/m$^2$H° C. or thereabouts will be obtained at the most. Therefore, to attain the sufficient preheating effect, it is necessary to use a large-sized preheater, which is high in cost and requires much space; thus, practical use of such large-sized preheater has been difficult.

SUMMARY OF THE INVENTION

This invention is intended to solve such long-standing problems. That is, an object of the invention is to increase the coefficient of overall heat transmission of a preheater to thereby make it possible to obtain a small-sized compact form of preheater which provides a sufficient preheating effect.

An evaporator for evaporating a heat load liquid by heat exchange between a heating medium and said heat load liquid is provided with a preheater for the heat load liquid, so that the heat load liquid, prior to being fed to the evaporator, is preheated prior to being heated in the evaporator. In addition, the heat source may be obtained by reclaiming the heating medium discharged from the evaporator; besides this, is it also possible to use a separate suitable heating medium. Pumps, or other equivalent means such as ejectors, are installed at the inlet and outlet sides of the evaporator. The first pump at the inlet is used to feed a heat load liquid to be heated to the preheater, and the heat load liquid leaving the preheater is fed to the evaporator by the second pump. In one form of the invention where the heating medium is common to both the evaporator and preheater, a bypass is provided which establishes the communication between the inlet and outlet sides of the preheater in the heating medium line, and a flow control valve is installed in the bypass. The delivery pressure in the first pump and the flow rate of the heating medium are adjusted on the basis of the temperature and pressure of the heat load liquid at the outlet of the preheater and the preheater outlet temperature of the heating medium, in such a manner that the heat load liquid in the preheater is maintained at a temperature which is slightly lower than the saturation temperature. The heat load liquid preheated through the preheater is pressurized to a predetermined value by the second pump and fed to the evaporator.

In the preheater, the preheater outlet temperature of the heat load liquid is maintained lower than the saturation temperature, and as a result of heat being imparted thereto from the heating medium through a heat transfer partition wall, innumerable bubbles are produced in the vicinity of the heat transfer surface. Bubbles which leave the heat transfer surface come in contact with the flowing subcooled liquid, whereupon they are condensed to disappear. In this manner, the so-called subcool boiling heat transfer is effected, whereby a very great heat flow is obtained. Further, since the heat load liquid at the preheater outlet is maintained at a temperature which is lower than the saturation temperature, there is no possibility of bubbles being produced at least at the preheater outlet in spite of the fact that bubbles are produced in the vicinity of the heat transfer surface as described above. Therefore, normal operation of the second pump is ensured, so that the heat load liquid preheated by the preheater can be pumped by being pressurized to a desired pressure by the second pump.

In this invention, since the temperature of the heat load liquid at the preheater outlet is controlled so that it is maintained lower than the saturation temperature, subcool boiling heat transfer is effected at the heat load liquid side of the preheater, contributing much to increasing the coefficient of overall heat transmission. Moreover, at least at the preheater outlet, the heat load liquid does not boil and hence, there is no possibility of the second pump inhaling bubbles; thus, the heat load liquid passing through the preheater can be pressurized to a desired pressure and fed to the evaporator. Thus, according to the invention, a sufficient preheating effect can be attained without increasing the size of the preheater.

These and other features of th invention will become more apparent from the following description to be read in conjunction with the accompanying drawings.

DESCRIPTION OF THE PREFERRED EMBODIMENTS

Figure 1:
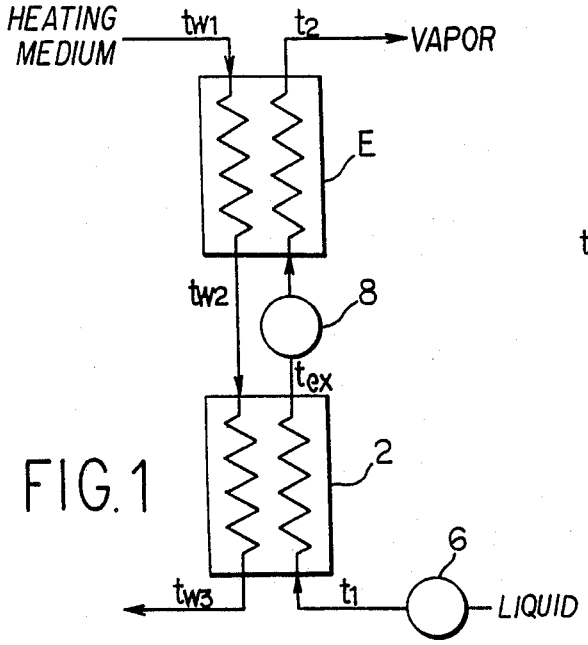
FIG. 1 is a block diagram of an evaporating apparatus embodying the invention.

Referring to FIG. 1, an evaporating apparatus with a preheater comprises an evaporator E for evaporating a heat load liquid by heat exchange between a heating medium and the heat load liquid, a preheater 2 for preheating the heat load liquid by heat exchange between the heating medium discharged from the evaporator E and the heat load liquid prior to being fed to the evaporator E, a first pump 6 for feeding to the preheater 2 the heat load liquid at a saturation pressure corresponding to a temperature slightly higher than the heat load liquid temperature $t_{ex}$ at the preheater outlet, and a second pump 8 for pressurizing the heat load liquid to a saturation pressure corresponding to the evaporation temperature $t_2$ when the heat load liquid is moving from the preheater 2 to the evaporator E.

The heat load liquid pressure in the preheater 2 is maintained at the saturation pressure corresponding to a temperature slightly higher than the preheater outlet temperature $t_{ex}$. Therefore, the heat load liquid is heated at a temperature higher than the saturation temperature and it is heated through boiling heat transfer. At this time, since the temperature of the heat load liquid is lower than the saturation temperature, the so-called subcool boiling results. Generally, the boiling heat transfer coefficient is 10 times as high as that for the turbulent heat transfer of liquid; therefore, the intended preheating effect can be attained without increasing the size of the preheater.

In addition, the delivery pressures of the pumps 6 and 8 can be easily controlled by feeding back the pressures at the outlets of the preheater 2 and evaporator E to a control device. These pumps may be replaced by other equivalent means such as ejectors.

By way of example, an application of this invention to the preheating of flon serving as a working fluid in a flon turbine generating system will now be described in detail.

Figure 2:
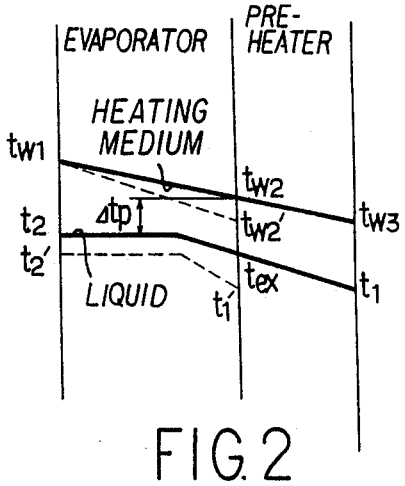
FIG. 2 is a diagram showing the temperature gradient of a fluid in the evaporator; the dotted line indicating a case where an evaporator alone is used and the solid line indicating another case where a preheater is added thereto.
Figure 3:
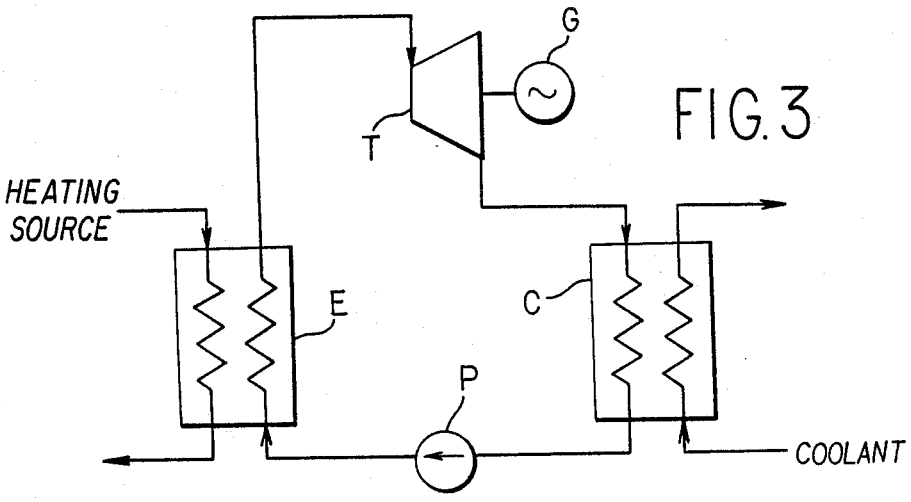
FIG. 3 is a block diagram of a flon turbine generating system for explaining an embodiment of the invention.

First, the outline arrangement of a flon turbine generating system is shown in FIG. 2. It comprises an evaporator E, for evaporating flon, which is a working fluid, by heating it with industrial wastewater or the like serving as a heat source, a vapor prime mover I, such as a vapor turbine or a volumetric expander, such as a screw expander, adapted to be driven for rotation by the high temperature high pressure flon vapor produced in said evaporator, a condenser C for cooling and condensing the flon vapor reduced in pressure as it has done work, and a flon circulation pump P for feeding the liquefied flon back to the evaporator E; these components are connected together in a closed loop and the output shaft of the vapor turbine or the like T is connected to an electric generator G.

The function of this evaporator E is to evaporate the liquid phase flon to cause the latter to take the latent heat for vapor away from the heat source fluid, so as to produce high temperature high pressure flon vapor. And the higher the evaporation temperature of flon, the greater the output of the system.

Thus, as a method for obtaining higher pressure from the same heat source, the evaporation temperature in the evaporator is increased by preheating the flon liquid. That is, as shown in dotted lines in FIG. 2, generally the evaporation temperature $t_2'$ is determined by (outlet temperature $t_{w2}$ of heating medium)-$\Delta t_p$; thus, since the outlet temperature of the heating fluid is raised from $t_{w2}'$ to $t_{w2}$ as shown in solid lines in the same figure by installing the preheater, the evaporation temperature can be correspondingly raised from $t_2'$ to $t_2$.

Figure 4:
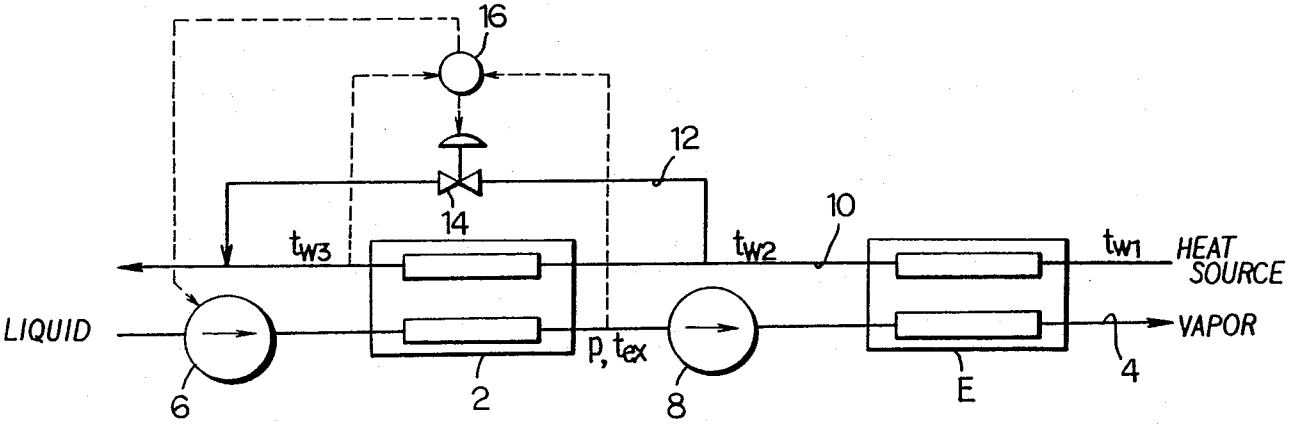
FIG. 4 is a block diagram showing another embodiment of the invention.

In FIG. 4, the preheater 4 is connected in series to the evaporator E, and a line 4 for circulation of flon, which is a heat load liquid, is provided with first and second pumps 6 and 8 disposed at the inlet and outlet sides of the preheater 2, respectively. A heating medium line 10 is provided with a bypass 12 for establishing the communication between the inlet and outlet sides of the preheater 2, said bypass 12 having a flow control valve 14 attached thereto. The numeral 16 denotes a control device which receives inputs in the form of the temperature $t_{ex}$ and pressure P of flon at the outlet of the preheater 2 and the preheater outlet temperature $t_{w3}$ of the heating medium, performs predetermined calculations on the basis of these items of information, and feeds control signals to the flow control valve 14 and first pump 6, as will be later described.

To cause subcool boiling heat transfer to take place in the preheater 2, it is necessary to maintain the flon temperature lower than the saturation temperature. Further, to maintain the entire system, the flon heated through the preheater is pressurized to a predetermined pressure by the second pump 8 and then fed to the evaporator E. At this time, it is necessary to ensure that the flon contains n bubbles at the outlet of the preheater 2. Otherwise, the second pump 8 could not operate properly. That is, if bubbles are produced in the flon, the second pump 8 fails to pressurize the flon to a predetermined pressure and besides this, there is the danger of cavitation taking place to damage the pump. For this reason, it is necessary to see to it that no bubbles are produced at the preheater outlet.

Figure 5:
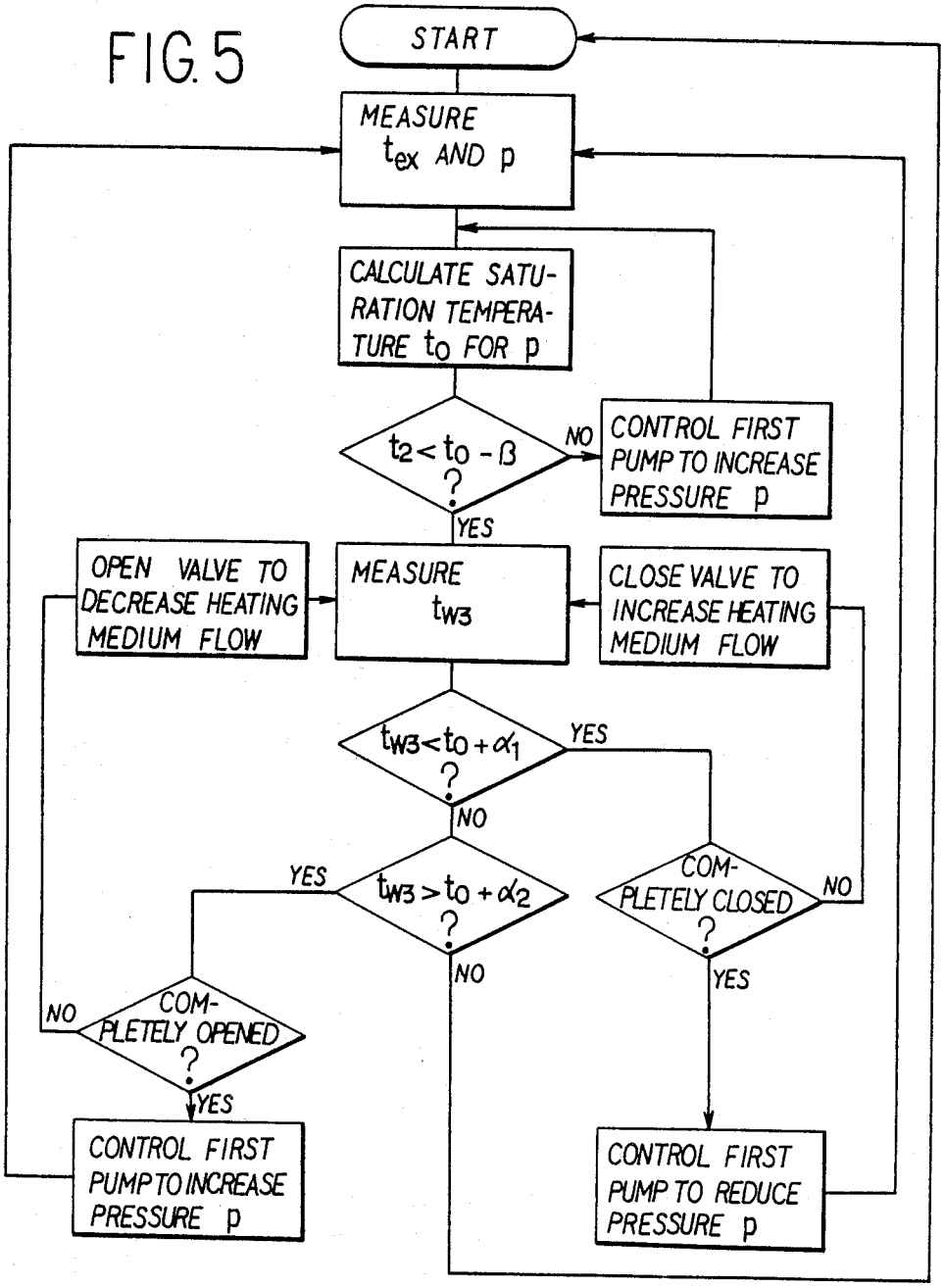
FIG. 5 is a flowchart showing the concrete procedure for embodying the invention.

A concrete method of control will now be described with reference to a flowchart shown in FIG. 5.

First, the temperature $t_{ex}$ and pressure P of the flon at the outlet of the preheater 2 are measured. From the measured pressure P, the saturation temperature $t_o$ corresponding to the pressure is found by calculation. And the measured temperature $t_{ex}$ is compared with a value $(t_o-\beta)$, which is slightly less than the saturation temperature $t_o-\beta$ being a constant. The first pump 6 is controlled so that $t_{ex}<T_o-\beta$. That is, during $t_{ex}\geqq t_o-\beta$, the first pump 6 is controlled to raise the preheater outlet pressure P of the flon. When $t_{ex}<t_o-\beta$, the preheater outlet temperature $T_{w3}$ of the heating medium is measured. And this measured value $t_{w3}$ is compared with the saturation temperature of the flon plus a predetermined value, i.e. $(t_o+\alpha_1)$, and if $t_{w3}<t_o+\alpha_1$, then the flow control valve 14 is closed to reduce the bypass quantity, thereby increasing the rate of flow of heating medium to the preheater 2. In addition, a decision is made on whether or not the flow control valve 14 is completely closed. If the decision is that it is completely closed, the first pump 6 is controlled to reduce the preheater outlet pressure P of flon, whereupon the procedure returns to the start. If the decision is that the flow control valve 14 is not completely closed, then the preheater outlet temperature $t_{w3}$ of the heating medium is measured again to make a decision on whether or not $t_{w3}<t_o+\alpha_1$.

As a result, if the answer to $t_{w3}<t_o+\alpha_1$ is no, then a decision on whether or not $t_{w3}>t_o+\alpha_2$ is made, where the predetermined value $\alpha_2$ is greater than $\alpha_1$, and if the answer is yes, the flow control valve 14 is opened to increase the bypass quantity, thereby reducing the rate of flow of heating medium to the preheater 2. In addition, a decision on whether or not the flow control valve 14 is completely opened is made, and if it is completely opened, the first pump 6 is controlled to raise the preheater outlet pressure of flon, whereupon the procedure returns to the start. If the flow control valve 14 is not completely opened, the preheater outlet temperature $t_{w3}$ of the heating medium is measured to make a decision on whether or not $t_{w3}<t_o+\alpha_1$.

When the answers to $t_{w3}<t_o+\alpha_1$ and to $t_{w3}>t_o+\alpha_2$ are both no, that is, when $t_o+\alpha_1 \leqq t_{w3} \leqq t_o+\alpha_2$, this means that the saturation temperature $t_o$ of the flon at the preheater outlet is slightly lower than the preheater outlet temperature $t_{w3}$ of the heating medium. Therefore, so long as this state is maintained, the subcool boiling is maintained, and since $t_{ex}<t_o$, the state with no bubble formation is maintained.

What is claimed is:

1. An evaporating apparatus with a preheater, comprising:

an evaporator for evaporating a liquid by heat exchange between a heat source fluid and said evaporation liquid, a preheater for preheating the liquid by heat exchange between a heating medium and the liquid prior to being fed to the evaporator, a first means for feeding to the preheater the liquid at a saturation pressure corresponding to a temperature slightly higher than the liquid temperature at the preheater outlet, and a second means for pressurizing the liquid to a saturation pressure corresponding to the evaporation temperature as the liquid passes from the preheater to the evaporator.

2. The apparatus according to claim 1, wherein the rate of flow of the heating medium to the preheater is controlled such that the preheater outlet temperature of the liquid is maintained lower than the saturation temperature.

* * * * *